US005490580A

United States Patent [19]

Powell et al.

[11] Patent Number: 5,490,580

[45] Date of Patent: Feb. 13, 1996

[54] AUTOMATED SELECTION OF A LOAD WEIGHT BYPASS THRESHOLD FOR AN ELEVATOR SYSTEM

[75] Inventors: Bruce A. Powell, Canton; Joseph C. Walker, Avon, both of Conn.

[73] Assignee: Otis Elevator Company, Farmington, Conn.

[21] Appl. No.: 425,662

[22] Filed: Apr. 17, 1995

Related U.S. Application Data

[63] Continuation of Ser. No. 44,334, Apr. 7, 1993.

[51] Int. Cl.[6] ..... B66B 1/44; B66B 1/18

[52] U.S. Cl. ..... 187/281; 187/381; 187/392

[58] Field of Search ..... 187/392, 381, 187/281, 384, 387

[56] References Cited

U.S. PATENT DOCUMENTS

| | | | |
|---|---|---|---|
| 3,504,770 | 4/1970 | Savino et al. | 187/29 |
| 3,967,702 | 7/1976 | Iwaska et al. | 187/29 R |
| 3,999,631 | 12/1976 | Iwasaka et al. | 187/29 R |
| 4,026,389 | 5/1977 | Magee | 187/126 |
| 4,303,851 | 12/1981 | Mottier | 235/92 PK |
| 4,330,836 | 5/1982 | Donofrio et al. | 364/567 |
| 4,363,381 | 12/1982 | Bittar | 187/29 R |
| 4,411,337 | 10/1983 | Schröder et al. | 187/29 R |
| 4,458,787 | 7/1984 | Uetani | 187/29 R |
| 4,491,199 | 1/1985 | Shea et al. | 187/29 |
| 4,553,639 | 11/1985 | Uetani | 187/29 R |
| 4,691,808 | 9/1987 | Nowak et al. | 187/125 |
| 4,708,224 | 11/1987 | Schrooder | 187/122 |
| 4,760,896 | 8/1988 | Yamaguchi | 187/124 |
| 4,793,443 | 12/1988 | MacDonald et al. | 187/127 |
| 4,878,562 | 11/1989 | Schroder | 187/127 |
| 4,947,965 | 8/1990 | Kuzunuki et al. | 187/127 |
| 4,951,786 | 8/1990 | Haraguchi | 187/1 R |
| 4,984,174 | 1/1991 | Yasunobu et al. | 364/513 |
| 5,012,430 | 4/1991 | Sakurai | 364/513 |
| 5,022,498 | 6/1991 | Sasaki et al. | 187/127 |
| 5,035,302 | 7/1991 | Thangavelu | 187/125 |
| 5,046,019 | 9/1991 | Basehore | 364/513 |
| 5,054,585 | 10/1991 | Amano | 187/124 |
| 5,168,133 | 12/1992 | Bahjat et al. | 187/125 |
| 5,192,836 | 3/1993 | Schroder | 187/126 |
| 5,219,042 | 6/1993 | Sattar et al. | 187/127 |
| 5,243,155 | 9/1993 | Sirag, Jr. | 187/127 |
| 5,248,860 | 9/1993 | Sirag, Jr. | 181/127 |
| 5,252,789 | 10/1993 | Sirag, Jr. et al. | 187/124 |
| 5,258,586 | 11/1993 | Suzuki et al. | 187/124 |
| 5,258,587 | 11/1993 | Kezer et al. | 181/131 |
| 5,260,526 | 11/1993 | Sirag, Jr. | 187/127 |
| 5,260,527 | 11/1993 | Sirag, Jr. | 187/131 |
| 5,347,093 | 9/1994 | Kezer et al. | 187/131 |

FOREIGN PATENT DOCUMENTS

| | | | |
|---|---|---|---|
| 2115578 | of 0000 | United Kingdom | B66B 1/06 |
| 2148499 | 5/1985 | United Kingdom . | |
| 2195791 | 4/1988 | United Kingdom . | |
| 2230622 | 10/1990 | United Kingdom . | |

OTHER PUBLICATIONS

Otis N.A.E.O. Field Education Presentation 8 pages F.E.1.1.1.1.–15G.

Document 9–91, p. 2/3 dated Nov. 30, 1992.

*Primary Examiner*—Peter S. Wong
*Assistant Examiner*—Robert Nappi
*Attorney, Agent, or Firm*—Joseph P. Abate

[57] ABSTRACT

An automated arrangement selects one of a plurality of load weight bypass thresholds for an elevator car. The selection depends, for example, upon the car direction and the time of day. Alternative embodiments of the arrangement utilize in the selection either actual or estimated elevator car floor space. Fuzzy logic is used to estimate available floor space.

10 Claims, 17 Drawing Sheets

THE FUZZY MEMBERSHIP SET IS

MOVEMENT OF LUGGAGE = {LIGHT |0.0; MODERATE |0.2; HEAVY |0:7}

OR

AVAILABILITY OF SPACE = {LARGE |0.0; MEDIUM |0.2 SMALL |0.7}

HEAVY MOVEMENT OF LUGGAGE

NO MOVEMENT OF LUGGAGE

FOR CARS TRAVELING UP, THE THRESHOLD WOULD BE BASED ON THE EXTENT OF MOVEMENT OF, e.g., LUGGAGE AWAY FROM THE LOBBY. ALTHOUGH THE SAME THRESHOLDS ARE SHOWN, FOR UP AND DOWN TRAVELING CARS, DIFFERENT THRESHOLDS CAN BE USED.

LOAD WEIGHT BYPASS THRESHOLD – UP TRAVELING CARS

| IF MOVEMENT OF LUGGAGE FROM THE LOBBY IS... | THEN SET BYPASS UP THRESHOLD AT... |
|---|---|
| LIGHT OR NONE | 80% |
| SOME | 65% |
| HEAVY | 50% |

TABLE U

FIG.13A

LOAD WEIGHT BYPASS THRESHOLD – DOWN TRAVELING CARS

| IF MOVEMENT OF LUGGAGE FROM THE LOBBY IS... | THEN SET BYPASS DOWN THRESHOLD AT... |
|---|---|
| LIGHT OR NONE | 80% |
| SOME | 65% |
| HEAVY | 50% |

TABLE D

FIG.13B

LIGHT $$M = \begin{cases} 1 \text{ IF } CLW \le 800 \\ -\frac{1}{900} CLW + \frac{1700}{900} \text{ IF } 800 < CLW \le 1700 \\ 0 \text{ IF } CLW > 1700 \end{cases}$$

MODERATE $$M = \begin{cases} 0 \text{ IF } CLW \le 1200 \\ \frac{1}{500} CLW - \frac{1200}{500} \text{ IF } 1200 < CLW \le 1700 \\ -\frac{1}{500} CLW + \frac{2200}{500} \text{ IF } 1700 < CLW \le 2200 \\ 0 \text{ IF } CLW > 2200 \end{cases}$$

HEAVY $$M = \begin{cases} 0 \text{ IF } CLW \le 1700 \\ \frac{1}{900} CLW - \frac{1700}{900} \text{ IF } 1700 < CLW \le 2600 \\ 1 \text{ IF } CLW > 2600 \end{cases}$$

EQUATIONS FOR FUNCTION M
OF
FIG.15

FIG.16

LIGHT $$M=\begin{cases} 1, \text{ IF } CLW \le CLW_1 ; \\ -\dfrac{1}{(CLW_{3,4,5}-CLW_1)}(CLW)+\dfrac{CLW_{3,4,5}}{(CLW_{3,4,5}-CLW_1)}, \text{ IF } CLW_1 < CLW \le CLW_{3,4,5}; \\ 0, \text{ IF } CLW > CLW_{3,4,5}. \end{cases}$$

MODERATE $$M=\begin{cases} 0, \text{ IF } CLW \le CLW_2; \\ \dfrac{1}{(CLW_{3,4,5}-CLW_2)}(CLW)-\left(\dfrac{CLW_2}{(CLW_{3,4,5}-CLW_2)}\right) \\ \qquad \text{,IF } CLW_2 < CLW \le CLW_{3,4,5}; \\ 0, \text{IF } CLW > CLW_6. \end{cases}$$

$$-\frac{CLW}{(CLW_{3,4,5}-CLW_2)}+\left(\frac{CLW_6}{(CLW_{3,4,5}-CLW_2)}\right), \quad \text{IF } CLW_{,3,4,5} < CLW \le CLW_6;$$

HEAVY $$M=\begin{cases} 0 \text{ IF } CLW \le CLW_{3,4,5}; \\ \dfrac{1}{(CLW_6-CLW_{3,4,5})}(CLW)-\left(\dfrac{CLW_{3,4,5}}{(CLW_6-CLW_{3,4,5})}\right) \\ \qquad \text{,IF } CLW_{3,4,5} < CLW \le CLW_7; \\ 1, \text{IF } CLW > CLW_7. \end{cases}$$

AUTOMATED SELECTION OF A LOAD WEIGHT BYPASS THRESHOLD FOR AN ELEVATOR SYSTEM

This application is a continuation of U.S. patent application Ser. No. 08/044,334, filed on Apr. 7, 1993, now abandoned.

TECHNICAL FIELD

The present invention relates to elevator systems and, more particularly, to improvements in methods and arrangements for signaling the elevator system to cause an elevator car to bypass hall calls.

BACKGROUND OF THE INVENTION

It is known to weigh the amount of load (e.g., passenger weights) within an elevator car and to generate a first electrical signal when a fixed percentage of full elevator car capacity is equalled or exceeded. The electrical signal is transmitted to or generated within an electronic car controller (e.g., electronic computer) for the elevator car to cause the car controller to command a particular elevator car to bypass hall calls. When the load within the particular elevator car decreases to a value below the fixed percentage (e.g., because passengers exit the car at a landing), a second electrical signal is transmitted to or generated within the car controller to command the car to answer appropriate hall calls. Typically, full capacity of an elevator car is 4,000 pounds and the fixed percentage is 80%. Values corresponding to the 4,000 pounds and to the 80% are conventionally stored, for example, in a computer memory of the controller. Usually, the controller receives a load weight signal (LW) corresponding to an actual load from load weight sensors disposed within the elevator car, calculates an actual percentage of full capacity, compares the actual percentage against the fixed percentage, and generates the first electrical signal to cause the controller to inhibit the car's response to hall calls while the fixed percentage is equalled or exceeded. The fixed percentage is known in the art as the load weight bypass threshold. The first electrical signal is commonly termed a load weight bypass threshold signal. Arrangements for generating the load weight bypass threshold signal responsive to a load weight signal LW are well known and commercially used in the art. Such arrangements exist, for example, in the ELEVONIC 411 elevator system manufactured and sold by the Otis Elevator Company.

It is also known to adjust the load weight bypass threshold to a low value during light traffic conditions and to a higher value during heavy traffic conditions so that the waiting time of passengers at floors can be reduced by having an elevator car that has reached its load limit bypass floors. See, for example, U.S. Pat. No. 4,708,224, "Apparatus for the Load Dependent Control of an Elevator," issued Nov. 24, 1987 by Joris Schröder, and U.S. Pat. No. 3,504,770, "Elevator Supervisory System," issued Apr. 3, 1970, by H. C. Savino et al.

Nevertheless, the present inventors believe that improvements in arrangements and methods for adjusting load weight bypass thresholds are achievable.

In order to increase group elevator performance, an elevator car should stop for a hall call when there is ample or sufficiently available space (e.g., floor space) in the elevator car for the waiting passengers and should bypass the hall call when there is not ample space. A situation often encountered in buildings such as hotels or hospitals, etc. is that guests, porters, attendants and/or patients often carry luggage or the like onto the elevator car. Thus, the available floor space in the elevator car frequently will be filled, but not filled with sufficient load weight to activate the load weight bypass feature—i.e., to generate the load weight bypass threshold signal. Thus, an elevator car having insufficient available space will stop for a hall call but the waiting passengers will be unable to board and must re-enter a hall call.

SUMMARY OF THE INVENTION

According to the present invention, an apparatus for selecting an elevator load weight bypass threshold includes a memory, a plurality of elevator load weight bypass thresholds stored within the memory, an electronic processor electronically connected to the memory, and instructions for selecting one of the load weight bypass thresholds from among the plurality of stored thresholds. In one preferred embodiment of the invention, the selection is dependent solely upon the time of day that the computer instructions are executed by the electronic processor. In a further preferred embodiment of the present invention, the arrangement further includes an energy detecting and data processing means for generating a signal corresponding to an observed amount of space available within an elevator car, and instructions for selecting the load weight bypass threshold depending upon the time of day and upon the observed amount of space available within the elevator car. In a still further preferred embodiment of the present invention, the instructions select a threshold depending upon the time of day that the instructions are executed and also upon an estimated amount (instead of an observed amount) of space available within the elevator car. The estimated amount of space is determined, for example, utilizing fuzzy logic. The invention also includes a method for selecting an elevator load weight bypass threshold.

It is a principal object of the present invention to increase overall group elevator performance.

It is an additional object of the present invention to adjust automatically the elevator load weight bypass threshold depending upon the time of day and the car direction.

It is a still further object of the present invention to adjust automatically the load weight bypass threshold depending upon an observed space available within an elevator car.

It is a still additional object of the present invention to adjust the load weight bypass threshold depending upon an estimated amount of space available within an elevator car.

It is a still further object of the present invention to employ fuzzy logic to estimate an amount of space available within an elevator car.

Further and still other objects of the present invention will become more readily apparent in light of the following detailed description when taken in conjunction with the accompanying drawing, in which:

BRIEF DESCRIPTION OF THE DRAWING

FIG. 13A and FIG. 13B, shows Tables U,D of two preferred groups of load weight bypass thresholds; one threshold of Table U is used for a car while the car is traveling in the up direction, and one threshold of Table D is used for a car while the car is traveling in the down direction;

FIG. 16 is a table of equations defining the membership curves M of the fuzzy function of FIG. 15.

DETAILED DESCRIPTION OF THE PREFERRED EMBODIMENT AND BEST MODE

Figure 1:
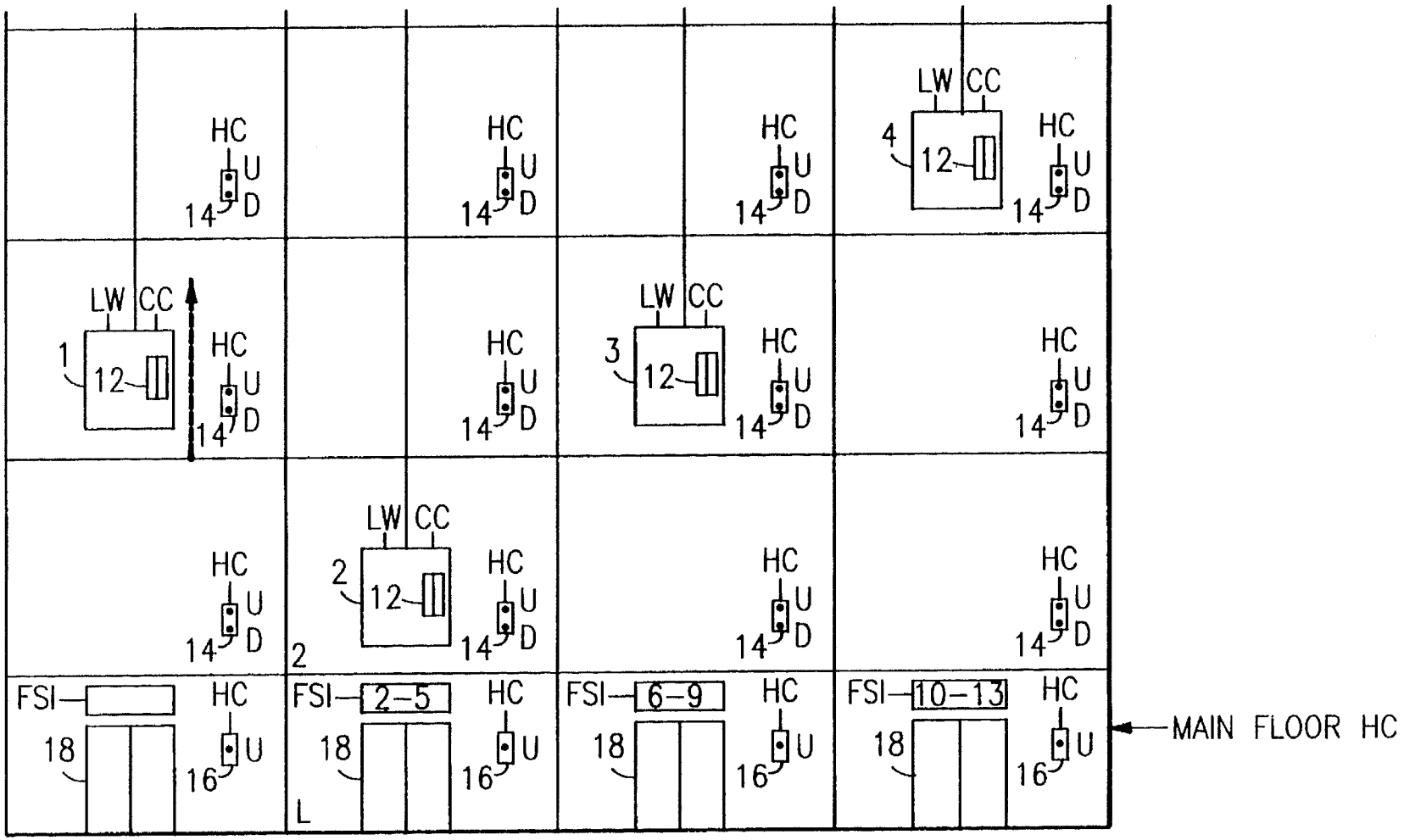
FIG. 1 is a schematic view of four elevators of an exemplary eight-car elevator system.

FIG. 1 shows four elevator cars 1–4 of an exemplary eight-car group which serves a building having a plurality of floors. The building has a main floor-typically, a ground floor or lobby L. Each car contains a car operating panel 12 through which a passenger (not shown) makes a car call to indicate a destination floor. The passenger presses a button (not shown) on the panel 12 producing a car call signal CC which identifies the floor to which the passenger intends to travel. A hall call fixture 14 which initiates a hall call signal HC is provided on each of the floors to indicate the intended direction of travel by a passenger on the floor. At the lobby L, there is a hall call fixture 16 which permits a passenger to call a car to the lobby L.

During normal operation of the group, various traffic parameter signals govern the dispatching of the elevator cars. Such parameter signals include, for example, car load condition (car load weight) signals LW, hall call signals HC, car call signals CC, etc. Various apparatus and methods for generating and processing the signals LW, HC, CC, etc. corresponding to car loads, hall calls, car calls, etc., for controlling elevator cars are well understood in the elevator and electronic computer arts. See, for example, commonly owned U.S. Pat. No. 4,330,836, "Elevator Cab Load Measuring System," issued May 18, 1982, by Donofrio et al.; U.S. Pat. No. 4,497,391, "Modular Operational Elevator Control System," issued Feb. 5, 1985, by Mendelsohn et al., which are all hereby incorporated by reference. The '836 patent by Donofrio et al. teaches apparatus for generating the signals LW.

Figure 2B:
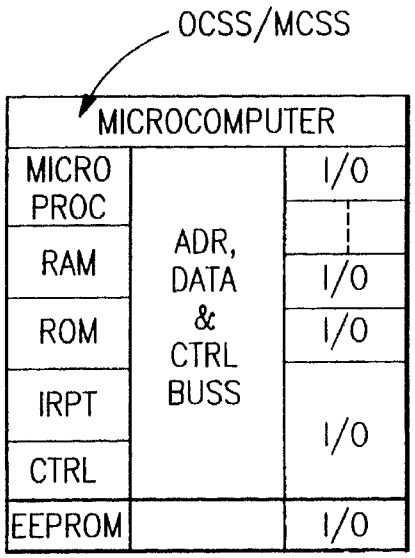
FIG.2B Prior Art
FIG. 2B is a block schematic diagram of an operational control subsystem including an electronic computer for executing instructions according to the present invention.
Figure 2A:
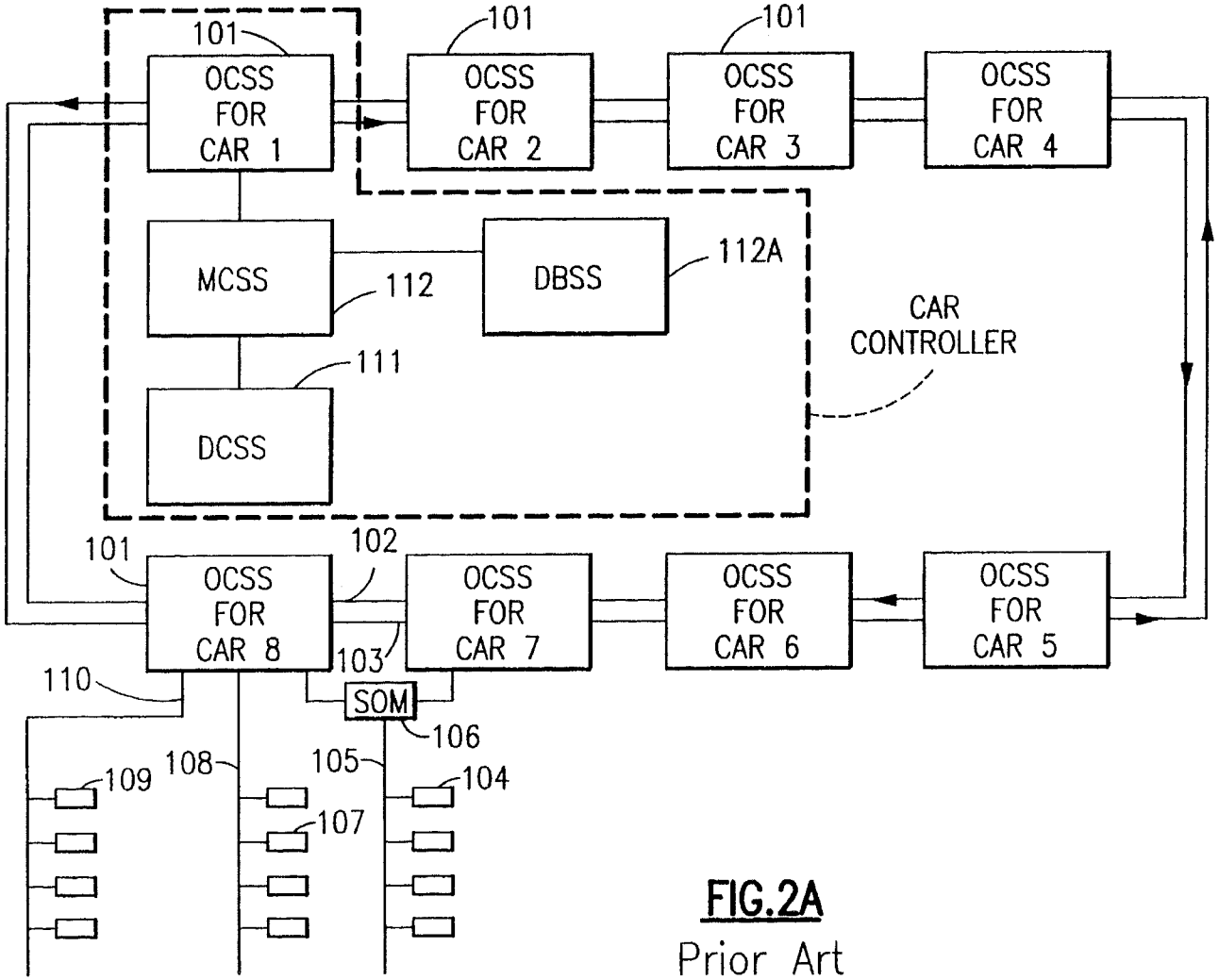
FIG.2A Prior Art
FIG. 2A is a block schematic diagram of a control arrangement for the exemplary eight-car elevator system, in which arrangement the present invention may be implemented.
Figure 2C:
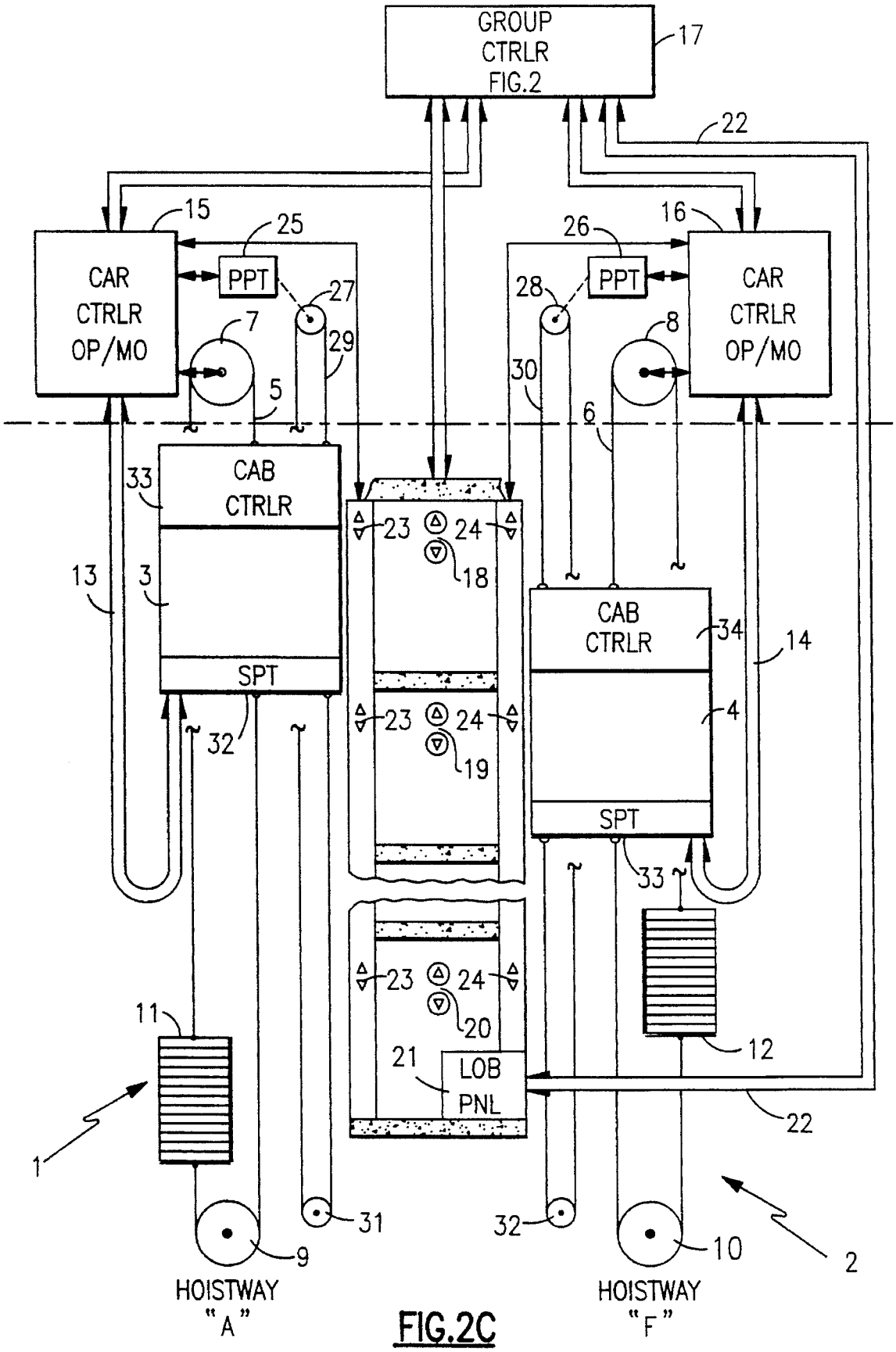
FIG.2C Prior Art
FIG. 2C is a schematic diagram of an alternative two-car group elevator system in which the present invention may be implemented, such diagram and reference numerals being keyed to those of U.S. Pat. No. 4,363,381.

The elevator cars 1–4 of FIG. 1 are operated under the control of an elevator group control system, such as that shown in FIG. 2. FIG. 2 shows an elevator group control system having an eight-car group configuration. Associated with each car 1–4 (FIG. 1) and with each car 5–8 (not shown) is a respective car controller (FIG. 2). Each car controller includes, for example, one operational control subsystem OCSS 101, one door control subsystem DCSS 111, one motion control subsystem MCSS 112 and one drive and brake subsystem DBSS 112A, all suitably electrically connected. The DCSS, MCSS and DBSS are under the control of the respective OCSS. Such a group control system is known, for example, from copending commonly-owned and allowed U.S. Pat. No. 5,202,540, "Two-Way Ring Communication System for Elevator Group Control," issued Apr. 13, 1993, by Auer and Jürgen, which is hereby incorporated by reference. In FIG. 2, elevator dispatching is distributed to the separate car controllers, one per car. Each OCSS is a microcomputer subsystem, while each MCSS, DCSS and DBSS is a microcomputer subsystem or other microprocessor based subsystem suitably electrically coupled to and controlled by its respective OCSS. All OCSSs, and thus all car controllers, are operationally interconnected by means of two serial links 102,103 in a two-way ring communication system. For clarity, MCSS, DCSS and DBSS are shown only in relation to one OCSS; however, it is understood that there are eight sets of these subsystems, one set associated with each elevator car and each set of OCSS, MCSS, DCSS and DBSS forming a car controller.

The call buttons and lights are connected with remote stations 104 and a remote serial communication link 105 to the OCSS 101 by means of a switchover module SOM 106. The car buttons, lights and switches are connected through remote stations 107 and a serial link 108 to the OCSS 101. The car specific hall features, such as car direction and position indicators, are connected to remote stations 109 and a remote serial link 110 to the OCSS 101. During normal operation of an elevator car (e.g., car 1), a car load measurement is periodically read (e.g., when the car 1 is stopped at a landing immediately before the car doors close for up-travel) by the respective door control subsystem DCSS 111, and a suitable signal LW is, for example, digitized by an A/D converter (not shown) and is transmitted to the respective motion control subsystem MCSS 112 and also to the respective operational control subsystem OCSS 101.

The dispatching function for each elevator car is executed and controlled by the respective OCSS forming a part of the respective car controller. Each OCSS, MCSS, etc. includes readily available hardware components such as a microprocessor, a volatile memory (e.g., Random Access Memory—RAM), a nonvolatile memory (e.g., Read Only Memory—ROM), an additional optional nonvolatile memory such as an Electronically Erasable and Programmable Read Only Memory (e.g., EEPROM or even FLASH "EEPROM"), various input and output ports, appropriate address, data and control buses, additional associated circuitry, optional external memory, and suitably stored software components such as a BIOS, an operating system, etc., all as is well understood by those skilled in the elevator and electronic computer arts. See, for example, FIG. 2B. Each OCSS typically also contains various computer programs for operating its respective car and for communicating with other OCSSs. Such various programs are well known to those skilled in the art and will not be further described. See, for example, commonly-owned U.S. Pat. No. 4,363,381, "Relative System Response Elevator Call Assignments," issued Dec. 14, 1982, by Bittar, which is hereby incorporated by reference.

Figure 7:
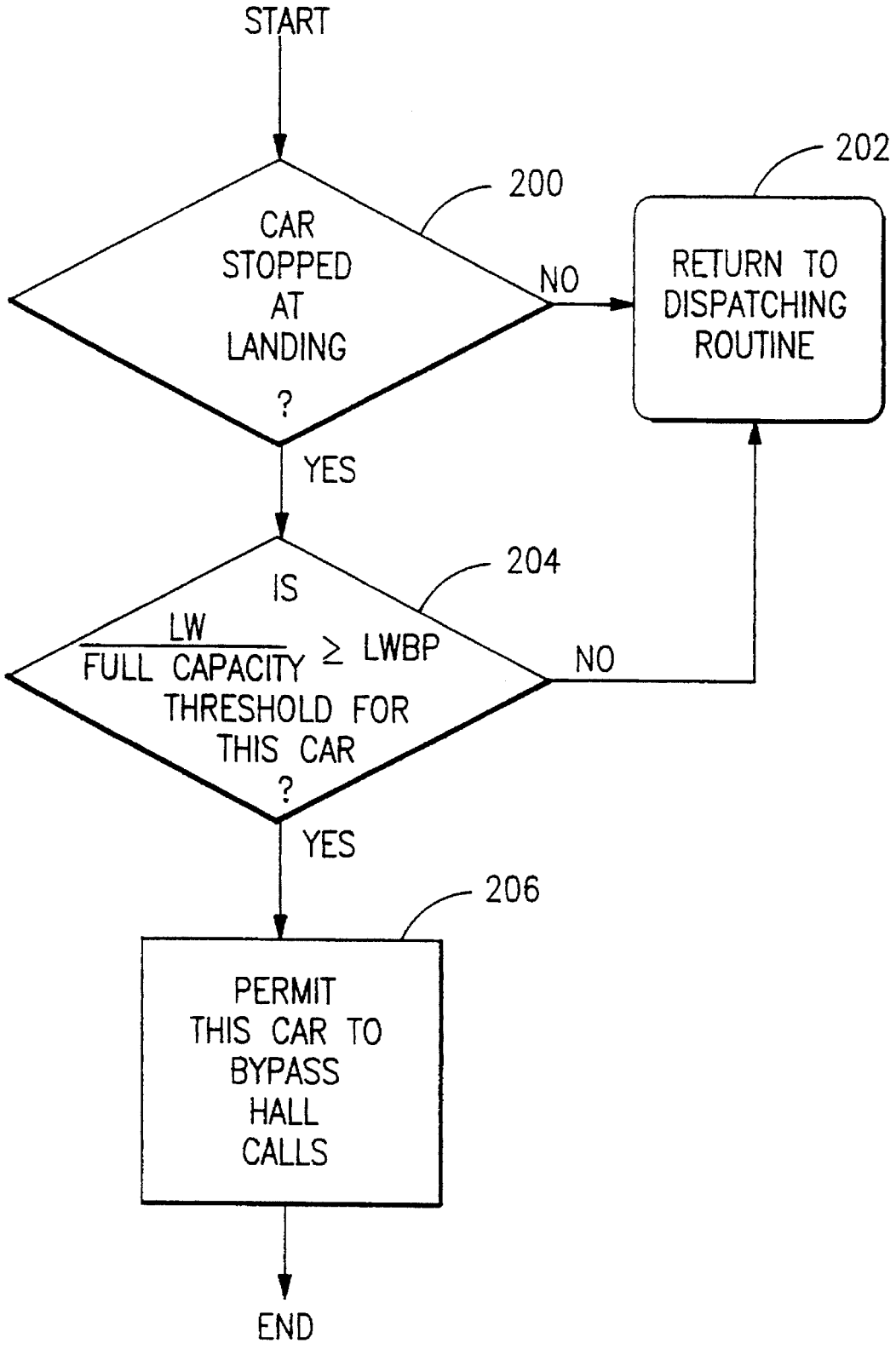
FIG.7 Prior Art
FIG. 7 is a logic flow diagram explaining use of a load weight bypass threshold according to the prior art.
Figure 8:
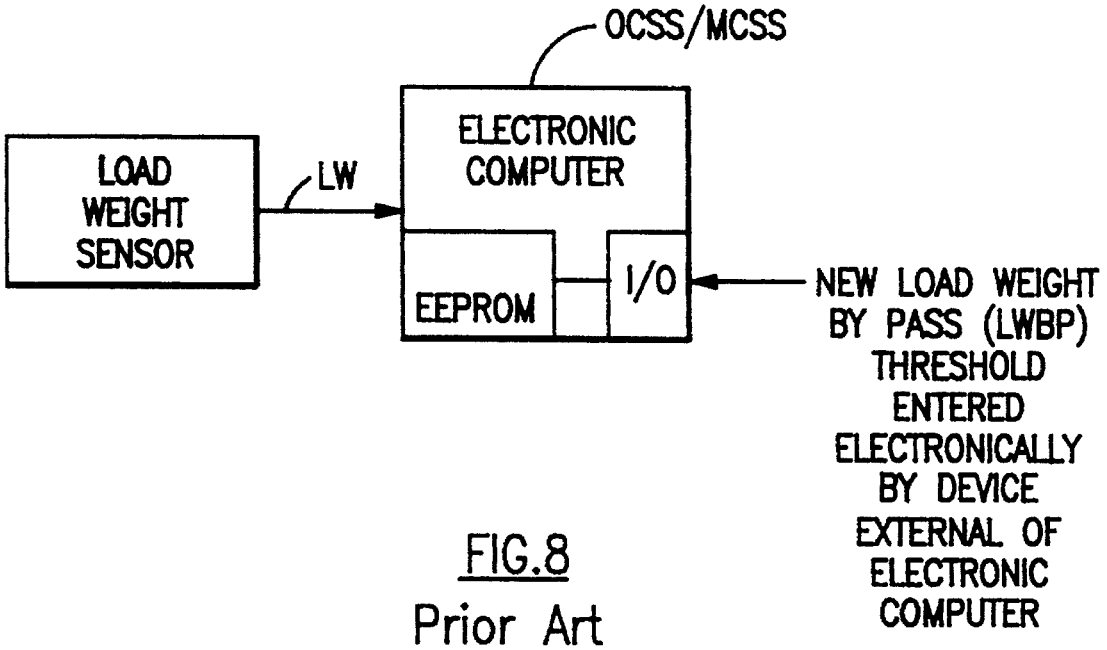
FIG.8 Prior Art
FIG. 8 is a schematic block diagram showing an elevator load weight sensor coupled to an elevator car controller having a load weight bypass threshold stored internally and adjustable through an I/O port according to the prior art.
Figure 9:
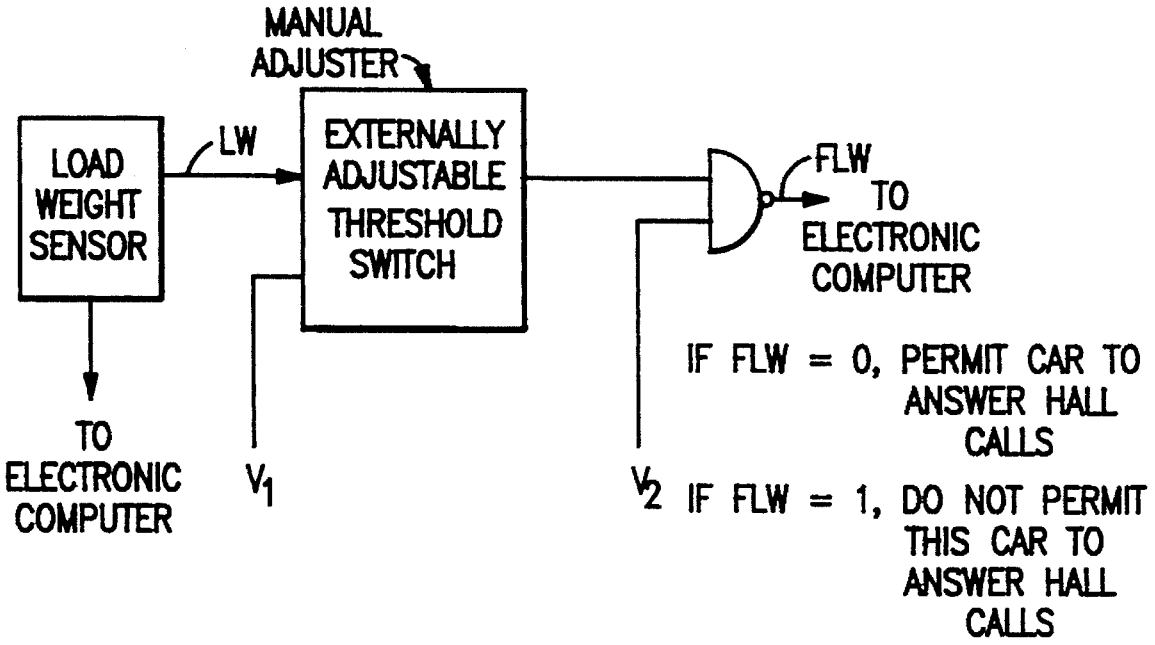
FIG.9 Prior Art
FIG. 9 is a schematic diagram showing an alternative arrangement of the prior art which generates a full load weight (FLW) signal equal to logic 1 when an externally (e.g., manually) adjustable threshold is equalled or exceeded by LW, and an FLW signal equal to logic 0 at other times.

According to the prior art, the routine shown, for example, in FIG. 7 is executed periodically by the OCSS 101 for the car 1. A step 200 ascertains whether or not the car is stopped at a landing. If no, a step 202 returns control to a normal dispatching routine such as that shown and described in U.S. Pat. No. 4,363,831. If yes in the step 200, a step 204 compares a [load weight condition signal LW÷ a full capacity signal] (in percent) against a LWBP threshold signal corresponding to a load weight bypass threshold (e.g., a percentage) previously stored in memory. For example, if full capacity= 4,000 pounds and LW= 1,000 pounds, then 1,000÷4,000= 25%. LWBP threshold may be 80%, i.e., 3,200 pounds. If no in step 204, return to step 202. If yes in step 204, a step 206 causes the OCSS (FIG. 8) internally to generate a hall call bypass signal such as full load weight (FLW)= logic 1, which is utilized by the dispatching software in the OCSS to command this car to bypass (i.e., not to answer) hall calls. Alternatively, an externally and manually adjustable threshold switch can be used to set a LWBP threshold desired by the building owner. Once a threshold is reached by a car, the circuit of FIG. 9 generates a full load weight (FLW) signal= logic 1 which is then utilized by the OCSS as previously described.

According to the invention (e.g., FIG. 3), the load weight bypass threshold changes (i.e., a new load weight bypass threshold is automatically selected) based upon the time of day. As an example, consider an elevator system in a hotel. During periods of heavy movement of luggage, elevator cars are likely to become full with luggage in addition to people. Typically, the weight per unit of floor area occupied by luggage is substantially less than the weight per unit of floor area occupied by a human being. Thus, it is desirable to set the LWBP threshold at a low number (e.g., 50% of full capacity) so that an elevator car that is only moderately loaded but has no available space (i.e., heavy movement of luggage into the car) will bypass hall calls. When the movement of luggage is minimal, i.e., light or none, a higher value (e.g., 80%) is used. In addition to being dependent on the time of day, the load weight bypass threshold according to the invention is direction dependent. During heavy movement of luggage down to the lobby (such as during morning checkout, e.g., 7:30 a.m. to 9:00 a.m.), a down threshold is, for example, 50% for cars traveling downwardly and an up threshold is, for example, 80% for cars traveling upwardly. These direction-dependent thresholds reside in, for example, tables which are stored, e.g., in the memory of an MCSS, and suitably read by the respective OCSS. These thresholds are automatically selectable by the elevator system according to the routine of FIG. 3 and are programmable, for example, by field personnel at the job site.

Figure 3:
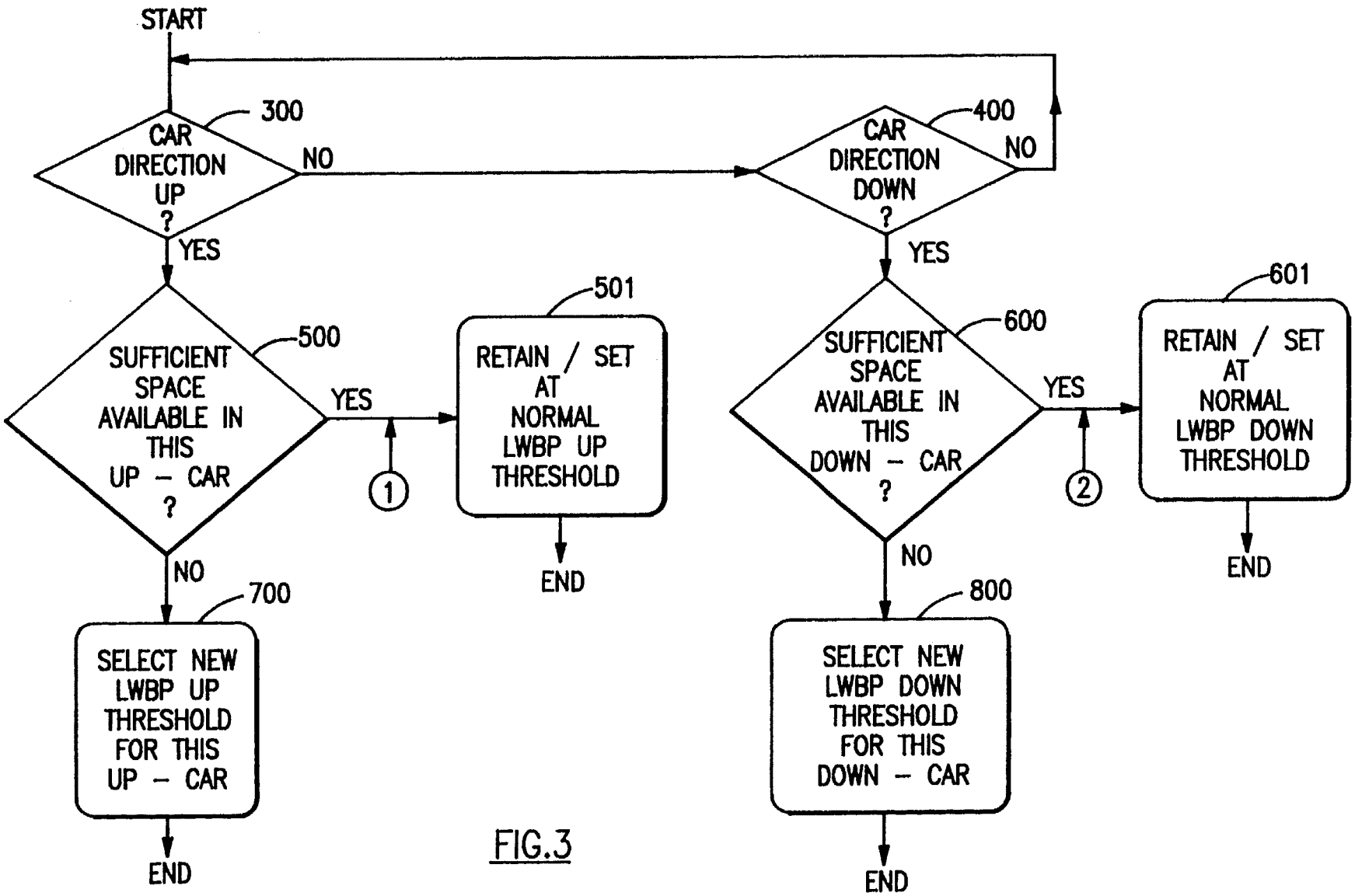
FIG. 3 is a logic flow diagram of a load weight bypass threshold selection routine according to the present invention.

According to the invention, the routine of FIG. 3 is repeatedly executed at suitable time periods, for example, when an elevator car is stopped at the lobby immediately before the doors close (i.e., up traveling cars) or is stopped at the lobby immediately before doors open (i.e., down traveling cars). A further explanation of the invention and its operation will now be provided with respect to up traveling cars located (e.g., stopped) at the lobby. The operation of the invention with respect to down traveling cars will be readily understood by those skilled in the art.

Figure 4A:
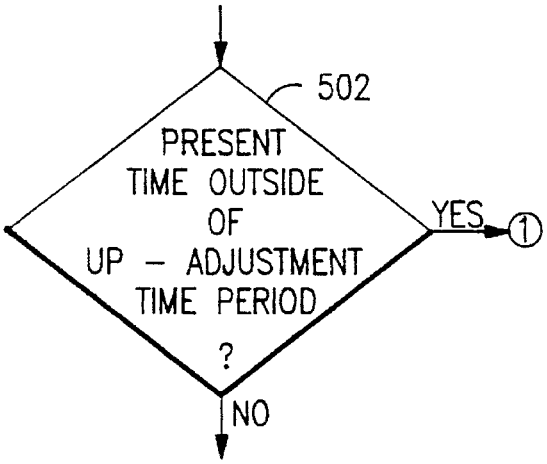
FIGS. 4A and 4B show details of one embodiment for the steps 500 and 600, respectively, shown in FIG. 3.
Figure 4B:
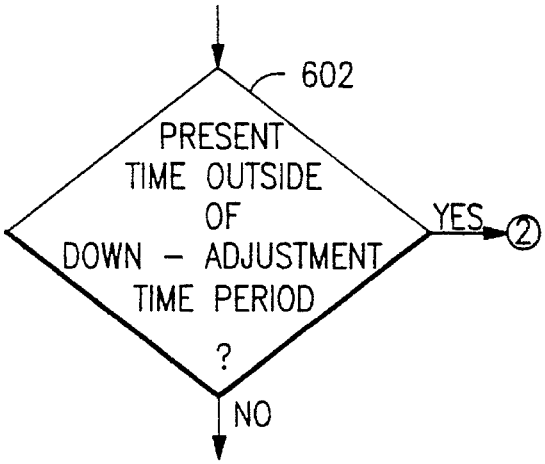
Figure 5A:
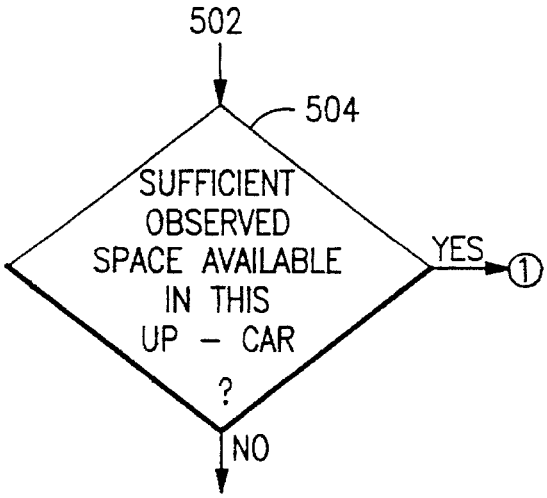
FIGS. 5A and 5B show details of another embodiment of the steps 500 and 600, respectively, shown in FIG. 3.
Figure 5B:
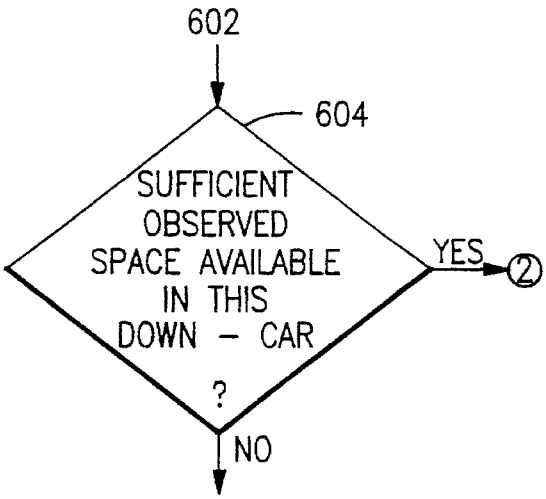

If the car 1 is located at the lobby immediately before the car doors close for upward travel, a step 300 of the routine of FIG. 3 as executed by the OCSS 101 for the car 1 results in a yes. The routine proceeds to a step 500 in which the space available in this car 1 is determined. According to one embodiment of the present invention, the step 500 includes the step 502, FIG. 4A. An up adjustment period begins, for example, at 4:30 pm and ends, for example, at 6:30 pm, during which guest check-in and heavy luggage movement typically occurs. The OCSS includes any suitably internal time clock. If the result of step 502 is no, a step 700 selects a new load weight bypass up threshold for this car, for example, 50% of full capacity. The load weight bypass down threshold is, for example, at 80% (normal LWBP down threshold) during the up adjustment period. If the step 500 results in a yes, a step 501 retains or sets the load weight bypass up threshold at the normal value, for example, 80% or 3,200 pounds. Desired adjustment periods are determined (e.g., empirically) and suitably programmed into the OCSS in any well known fashion.

Figure 10A:
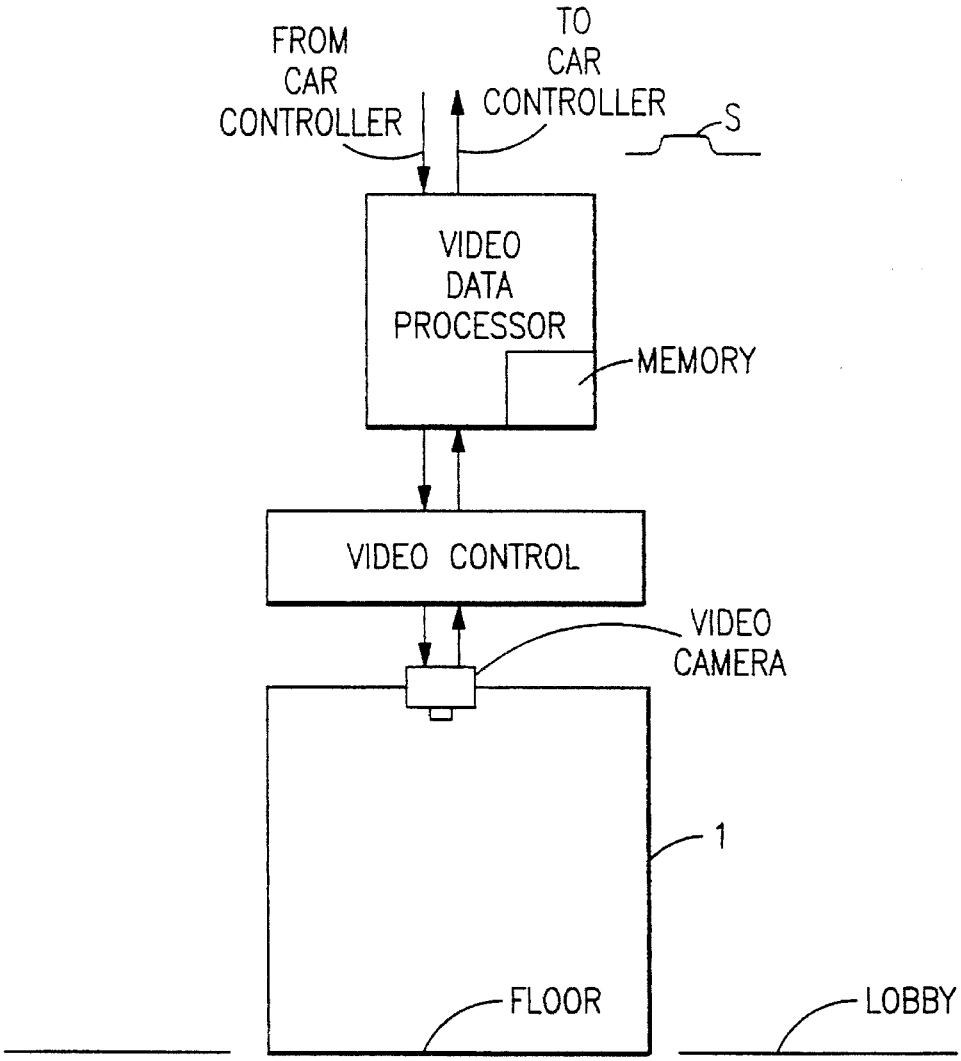
FIG. 10A and FIG. 10B is a schematic circuit diagram of a video camera viewing a floor of an elevator car, the camera being coupled to suitable video control and video data processing means for generating a signal corresponding to an observed amount of space available on the floor.
Figure 10B:
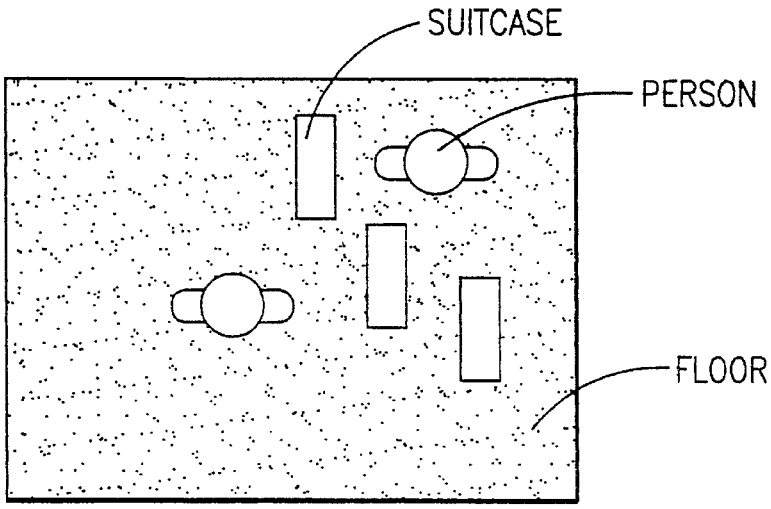

According to a further embodiment of the present invention, the step 500 includes the step 502 and a step 504. If the answer in the step 502 is no, a step 504 causes the OCSS to determine if there is sufficient observed space available in this car. To make this determination, the OCSS reads and processes a signal S generated by an energy detecting and data processing means. See FIG. 10. The means includes a video camera, video control (sync and blanking pulse generators, etc.) and a video data processor, all electronically interconnected and connected to the car controller in any conventional manner. The video camera is under a control of the video control and generates video data signals corresponding to the condition of the elevator floor as observed by the video camera. The video control and the data processor are directed by the car controller. The video data processor is a microcomputer having suitably stored (e.g., in a nonvolatile memory) baseline video data corresponding to video data signals generated by the camera when viewing an empty entire floor of one car. Immediately before the car doors close, the camera again scans the entire floor of the car and generates additional video data signals corresponding to the observed floor space. If any portions of the floor space are covered (e.g., by passengers or luggage), the corresponding additional video data signals will differ from the signals generated as a result of an empty floor. The data processor compares (e.g., subtracts) the baseline data signals against (e.g., from) the additional video data signals and outputs a signal S corresponding to the amount of observed floor space remaining available in the car. The combination of video camera, video control and data processor is conventional and requires no further description. See a modification of this combination in U.S. Pat. No. 4,303,851.

The means then generates the signal S to the OCSS which compares the signal S with a suitably stored value (e.g., >50%) corresponding to a sufficient amount of observed space available on the floor of this elevator car. For example, if the amount of observed space available on the floor is less than or equal to 50%, the step 504 will result in a no. If no in the step 504, the step 700 selects a new load weight bypass up threshold, for example, 50%.

Figure 6A:
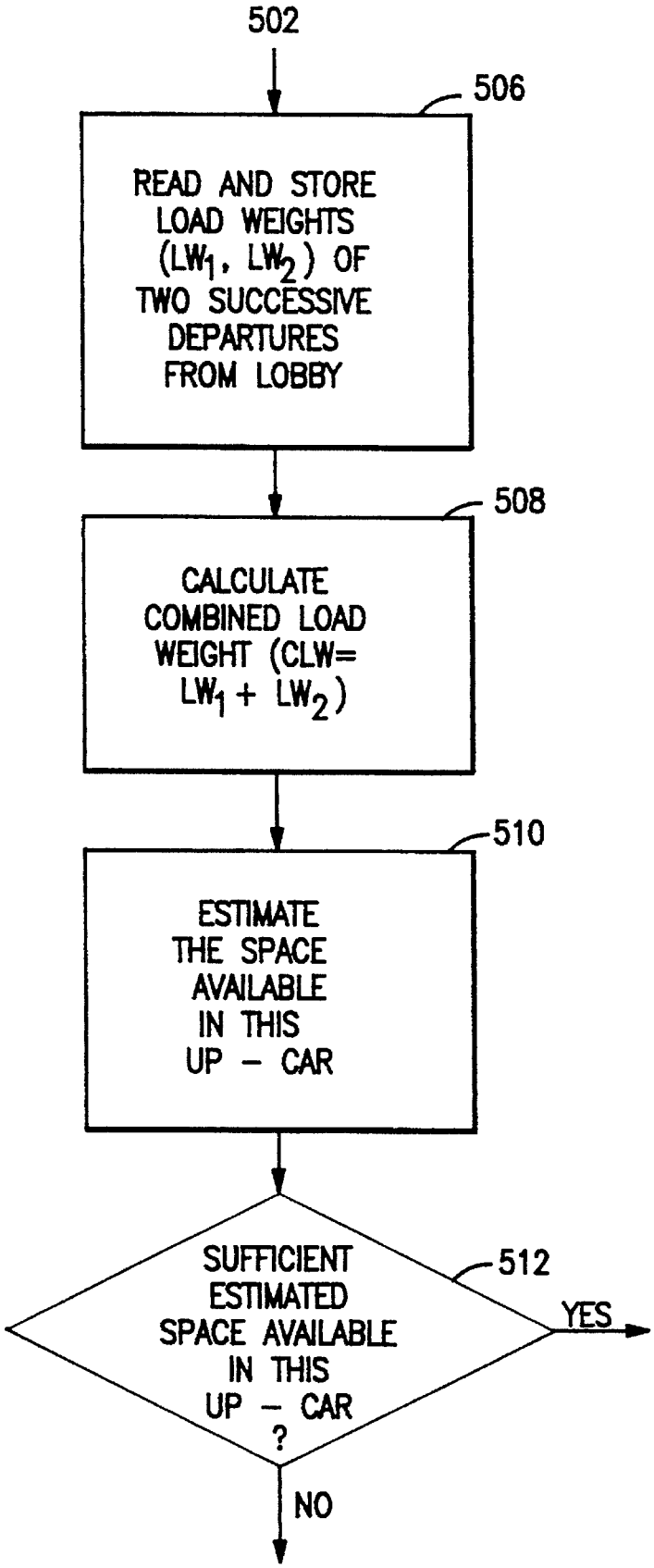
FIGS. 6A and 6B show logic flow diagrams of an additional embodiment for the steps 500 and 600, respectively, shown in FIG. 3.
Figure 6B:
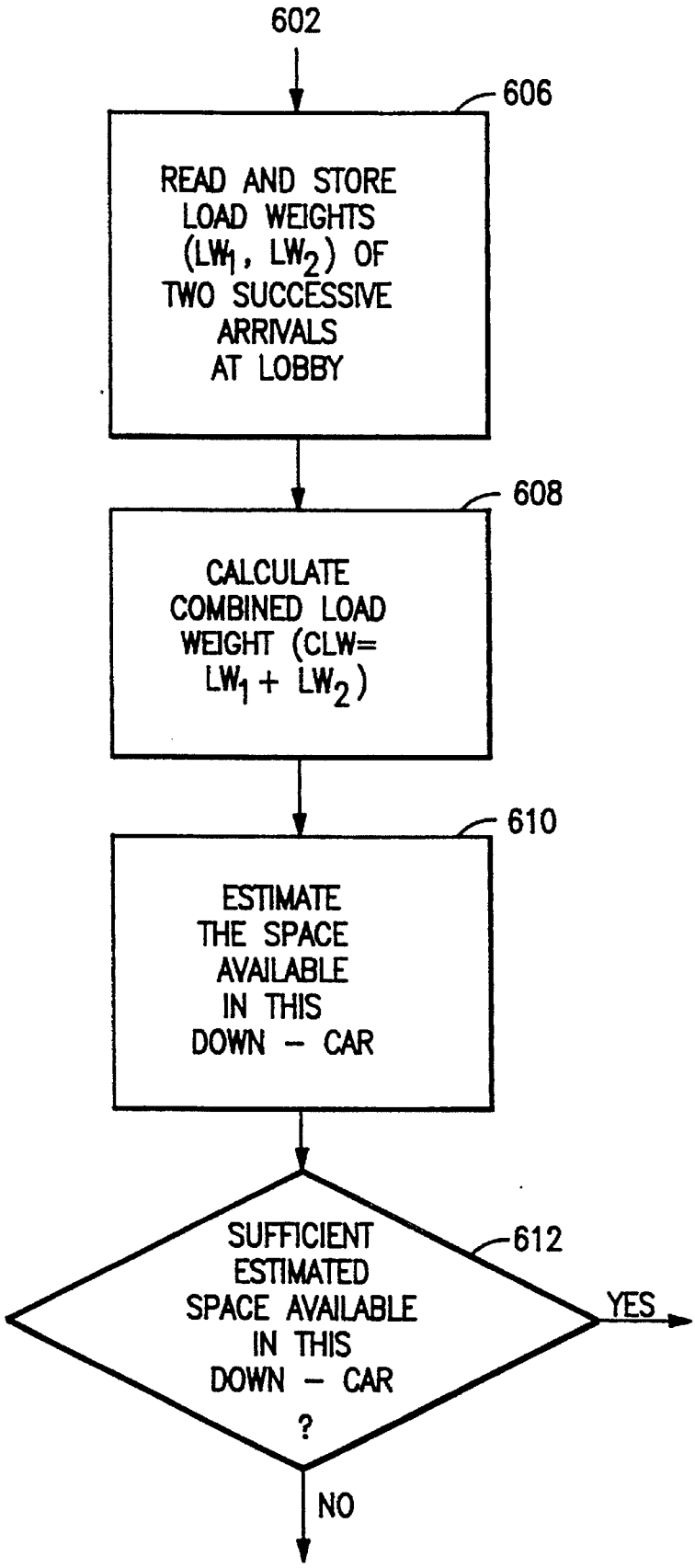
Figure 6C:
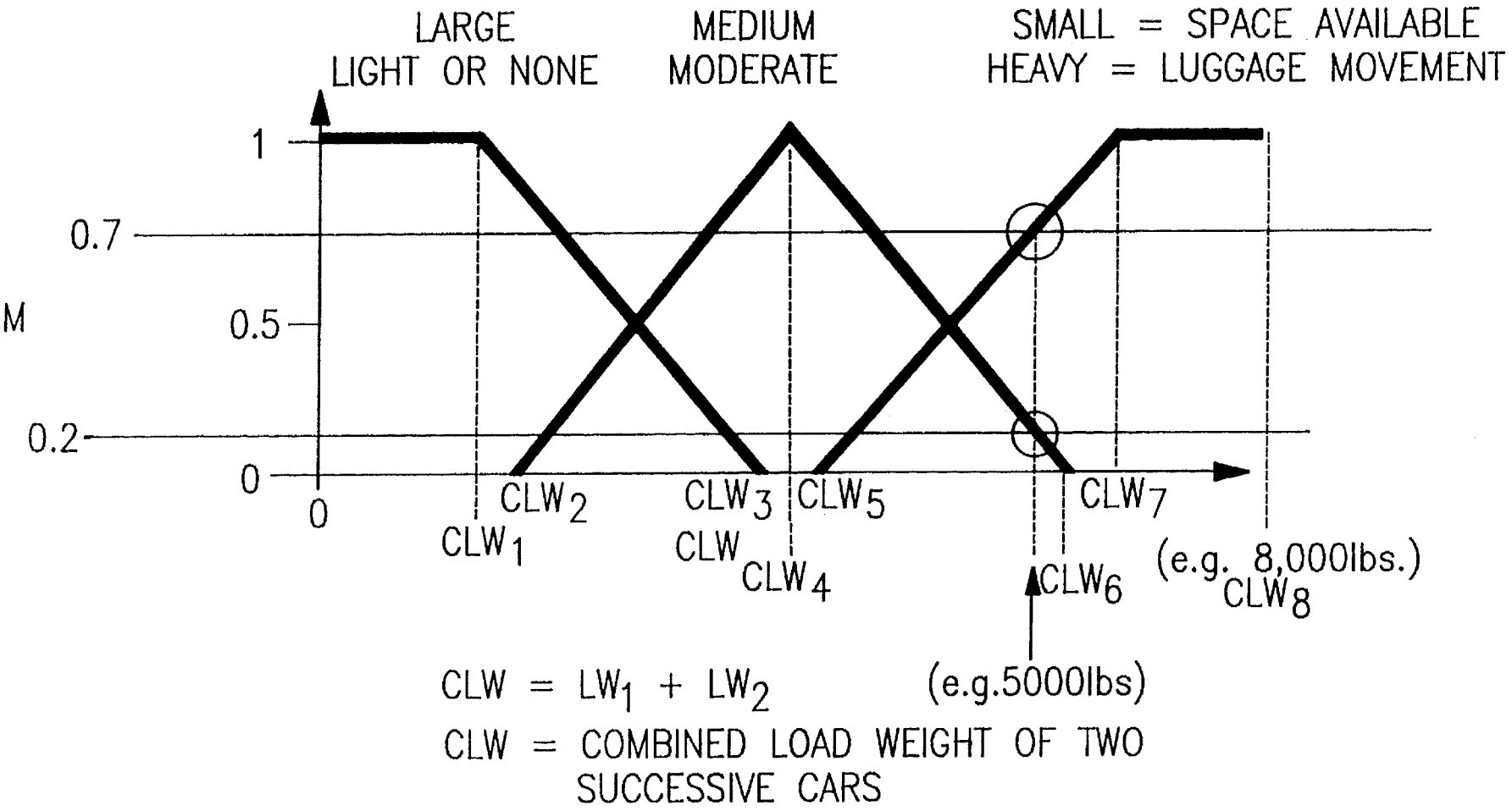
FIG. 6C is a graph of an exemplary fuzzy function of the invention used to estimate an amount of space available in an elevator car.
Figure 11:
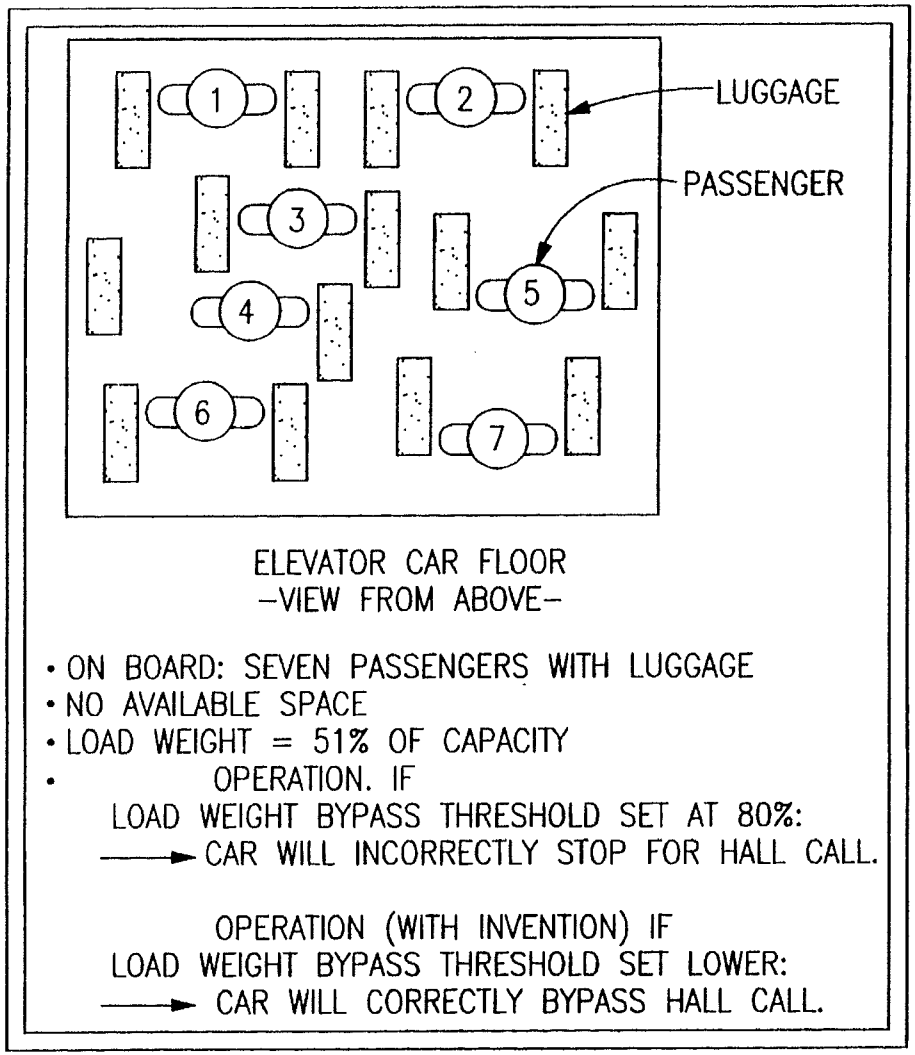
FIGS. 11 and 12 are schematic diagrams of respective elevator car floors having respective passengers; the diagrams include legends for further clarifying the present invention.
Figure 12:
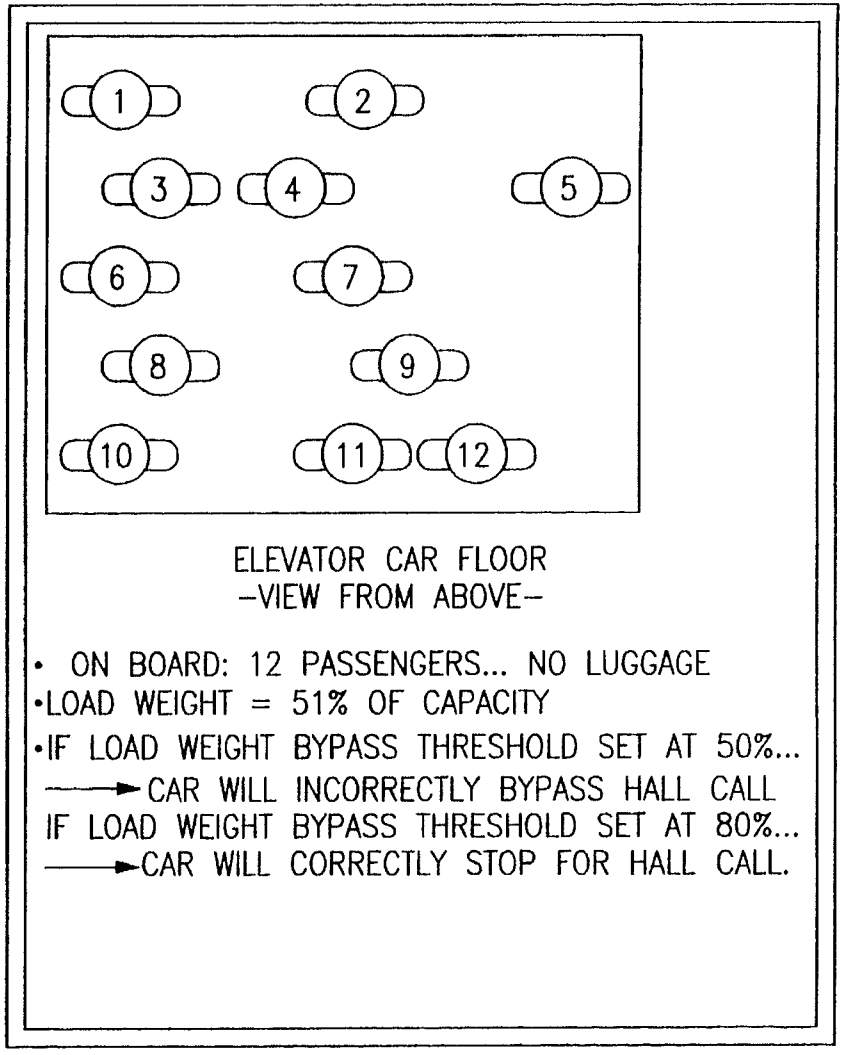

A further preferred embodiment of this invention is explained with reference to FIGS. 6A, 6B; the graphs of FIGS. 6C, 6D, 14, 15, 16; the charts of FIGS. 11, 12; and the Tables U,D of FIG. 13. Again, only the up-traveling car situation (FIG. 6A) needs to be discussed. The down-traveling car situation (FIG. 6B) will be readily understood in view of the discussion of FIG. 6A. The step 500 includes the steps 502,506,508,510 and 512. If no in the step 502, a step 506 reads and stores (e.g., into RAM) load weight signals $LW_1$ and $LW_2$ of two successive departures of this car (e.g., car 1) from the lobby. In a step 508, combined load weight (CLW) is calculated and equals the sum of $LW_1+LW_2$. In a step 510, an estimate is made of the space available in this up traveling car. A fuzzy function is, for example, used to provide this estimate. The fuzzy function and the Tables U,D (FIG. 13) are suitably stored, for example, within the EEPROM, FLASH or other memory of the OCSS. Fuzzy logic is well understood in the art and a thorough discussion of fuzzy logic and fuzzy functions can be found in Schmucker, K. J., *Fuzzy Sets, Natural Language Computations and Risk Analysis,* Computer Science Press, Rockville, Md., 1984.

Figure 6D:
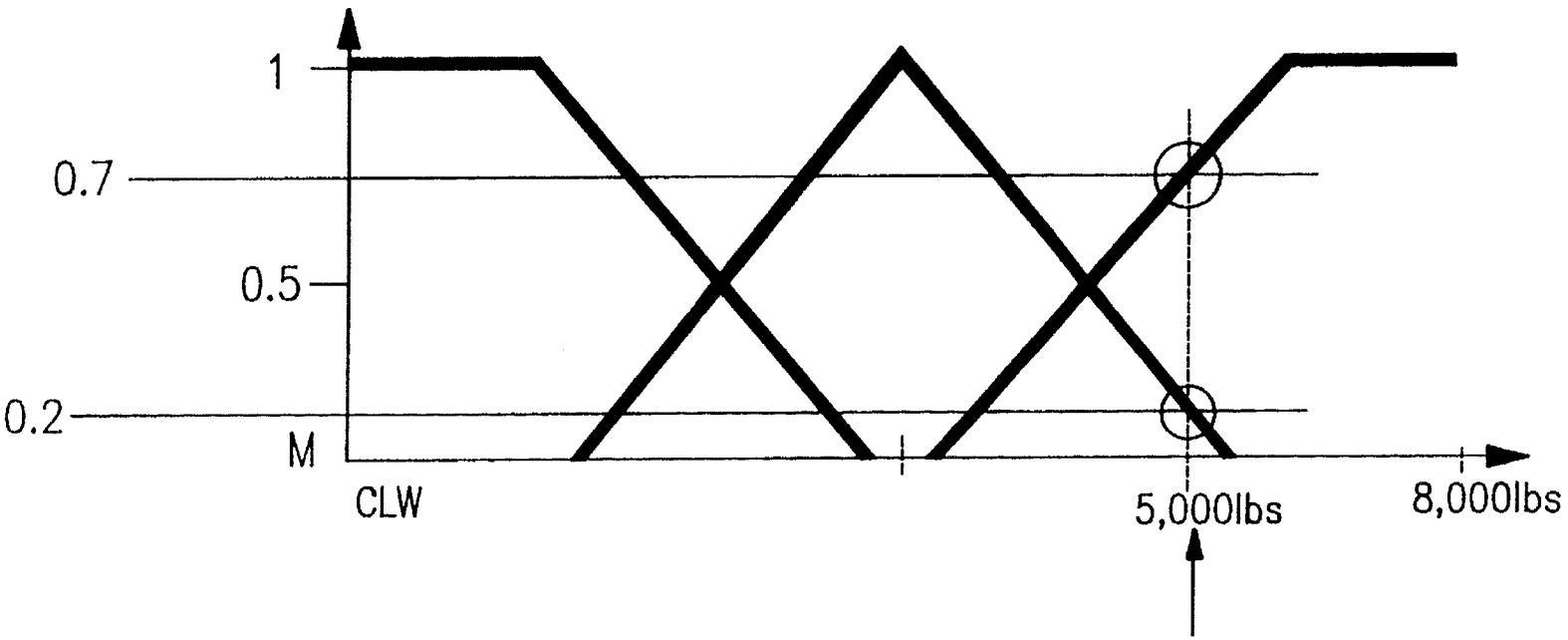
FIG. 6D is a graph and legend explaining one example using the fuzzy function of FIG. 6C.

For example, if the car 1 left the lobby with 2,000 pounds and its immediately successive trip from the lobby carried 3,000 pounds, then $LW_1+LW_2$ equals 5,000 pounds which equals the combined load weight (CLW), step 508. Five thousand pounds equals the value of the abscissa of the exemplary graphs shown in FIGS. 6C and 6D. The fuzzy membership set is shown in FIG. 6D. Light movement of luggage indicates a large space available in this car (step 510). If a maximum membership method for defuzzification is applied to this fuzzy membership set in the step 510, the movement of the luggage is most like "heavy" or, in other words, the estimated space available within this elevator car is most like "small." The routine of FIG. 6A then proceeds to a step 512 which produces a no result. The step 512 produces a yes if, for example, the estimated space available is "large." In this embodiment, the step 700 then suitably selects a new load weight bypass up threshold according to the rules (Table U) as shown, for example, in FIG. 13. Such Tables U,D are suitably stored within the memory of the OCSS. Preferably, once a new threshold is selected by one OCSS 101 of the group, a change threshold signal CT (not shown) is generated by that OCSS which commands each OCSS of the group to select an identical new load weight bypass threshold stored within each respective OCSS. The signal CT is transmitted to all OCSSs of the group via the link (e.g., 102).

Figure 14:
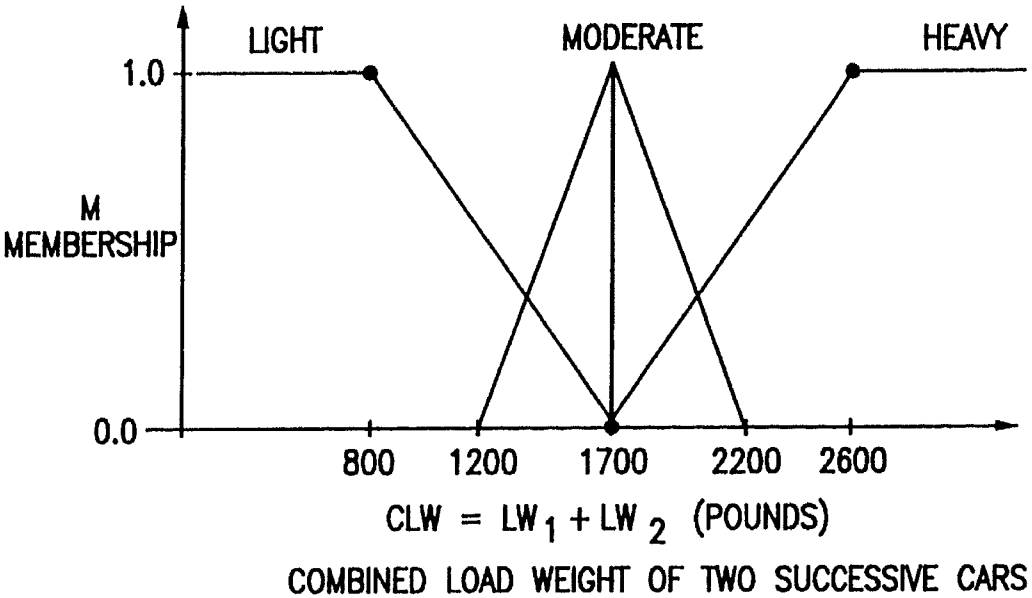
FIG. 14 is a graph with equations for another exemplary fuzzy function of the invention.
Figure 15:
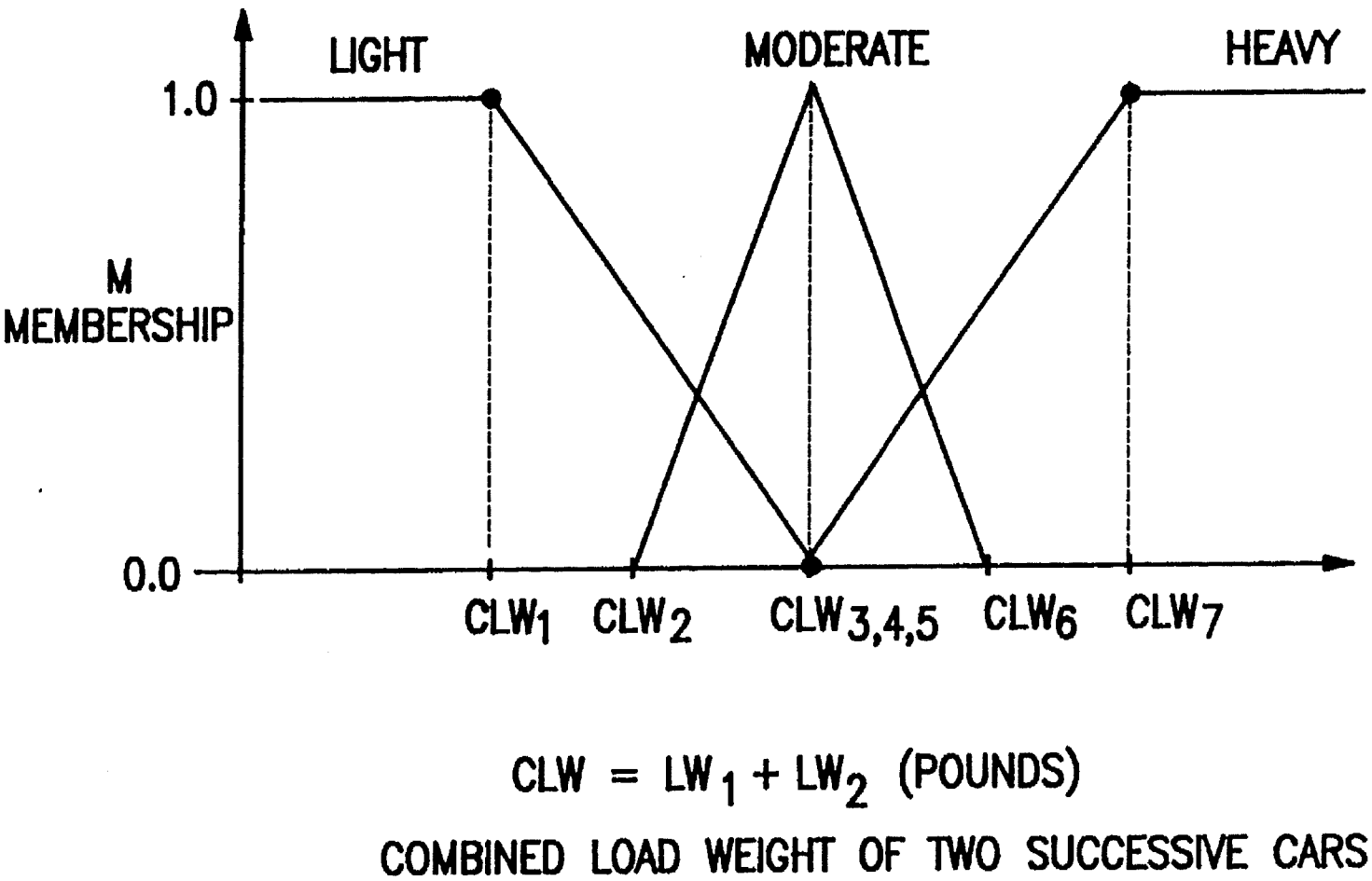
FIG. 15 is a graph for generalizing the fuzzy function of FIG. 14.

FIGS. 14, 15 and 16 show an additional fuzzy function (graphs and equations) according to the invention. In this case, $CLW= LW_1+ LW_2$.

Finally, coding and otherwise implementing the present invention is well within the skill of the art in view of the instant disclosure.

While there has been shown and described what is at present considered the preferred embodiments of the present invention, it will be apparent to those skilled in the art that various changes and modifications may be made therein without departing from the spirit and scope of the present invention which shall be limited only by the appended claims. For example, $LW_1$ could be a load weight of one car (e.g., car 1) departing from the lobby, while $LW_2$ could be a load weight of an immediately successive other car (e.g., car 3) departing from the lobby. Arrivals could be similarly handled by the invention.

What is claimed is:

1. An electronic computerized arrangement for selecting an elevator load weight bypass threshold, comprising:

an electronic computer including a memory;

a plurality of elevator load weight bypass thresholds stored within said memory; and instructions for selecting one of said elevator load weight bypass thresholds from among said plurality, the selection being dependent upon a time of day that said instructions are executed by said electronic computer and upon an estimated amount of floor space available within an elevator car, said instructions being stored within said memory, said estimated amount of floor space available corresponding to a point of a fuzzy function, said fuzzy function being stored within said memory, said memory further including instructions for controlling the elevator car to bypass a hall call while a load in the elevator car exceeds a selected one of said elevator load weight bypass thresholds.

2. An arrangement as claimed in claim 1, wherein said time of day is a time of day within a period beginning at 4:30 p.m. and ending at 6:30 p.m.

3. An arrangement as claimed in claim 1, wherein said time of day is a time of day within a period beginning at 7:30 a.m. and ending at 9:00 a.m.

4. An arrangement as claimed in claim 1, wherein said plurality of elevator load weight bypass thresholds includes a first threshold for an up direction of the elevator car and a second threshold for a down direction of the elevator car.

5. An arrangement as claimed in claim 4, wherein said first threshold differs from said second threshold.

6. An electronic computerized method for selecting an elevator load weight bypass threshold, comprising:

providing an electronic computer having a memory which includes a plurality of elevator load weight bypass thresholds, said memory further including instructions for performing at least steps (i)–(vi) of said method;

(i) ascertaining a time of day;

(ii) ascertaining load weights of two elevator cars located at a building lobby;

(iii) summing the load weights;

(iv) comparing the resultant sum against a fuzzy function;

(v) selecting a load weight bypass threshold from among said plurality of thresholds depending upon the result of said comparing step, and (vi) controlling at least one of the elevator cars to bypass a hall call while a load in the car exceeds the threshold selected in said (v) selecting step.

7. A method as claimed in claim 6, wherein said comparing step applying a maximum membership method to a fuzzy membership set.

8. A method as claimed in claim 6, wherein said step of ascertaining the load weights includes ascertaining the load weights of two successive departures of the same elevator car from the building lobby.

9. A method as claimed in claim 6, wherein said step of ascertaining the load weights includes ascertaining the load weights of different elevator cars departing from the building lobby.

10. A method as claimed in claim 6, wherein said step of ascertaining a time of day includes ascertaining a time of day within a period beginning at 4:30 p.m. and ending at 6:30 p.m.

* * * * *